United States Patent [19]

Nicoloso

[11] Patent Number: 4,609,798

[45] Date of Patent: Sep. 2, 1986

[54] MEANS FOR ASSEMBLING TWO ENCLOSURES OF AN ELECTRICAL CUTOUT APPARATUS

[75] Inventor: Dante Nicoloso, Jonage, France

[73] Assignee: Alsthom, Paris Cedex, France

[21] Appl. No.: 758,003

[22] Filed: Jul. 23, 1985

[30] Foreign Application Priority Data

Jul. 27, 1984 [FR] France ..... 84 12012

[51] Int. Cl.[4] ..... H01H 33/54

[52] U.S. Cl. ..... 200/148 R; 200/148 B; 200/148 F

[58] Field of Search ..... 200/148 R, 148 F, 148 B, 200/148 D, 148 E, 144 R

[56] References Cited

U.S. PATENT DOCUMENTS 4,386,250 5/1983 Nicoloso ..... 200/148 R

*Primary Examiner*—Robert S. Macon

*Attorney, Agent, or Firm*—Sughrue, Mion, Zinn, Macpeak & Seas

[57] ABSTRACT

The assembling means, in view of the subsequent separation of the two enclosures of an electrical cutout apparatus, comprises an intermediate, slidable sealing air lock with means operable to simultaneously seal one enclosure on one side thereof and the other enclosure on the other side thereof, said air lock comprising two separable portions which when separated respectively become fast with one and the other enclosures, the device control rod going through both enclosures having a part within said air lock provided with means for uncoupling the rod into two sections which are fast with respective portions of said enclosures, said air lock consisting of a cylindrical space established between the end of the first section of said rod and the inside of a hollow piston (15). The lower end of the first enclosure is provided with a first assembly plate for mounting on a second assembly plate on the upper end of the second enclosure, said first plate comprising a cylindrical sleeve against the inside of which is arranged a slide block (19) attached to the second plate, the head (7) of the piston (15) being slidably arranged and fitted with a seal within said cylindrical sleeve. To simplify assembly and disassembly, an internally threaded sleeve (111) is provided, which screws onto a thread on a portion of the outside surface of the slide block (19), together with means for making slidably fast said sleeve (111) with said piston (15).

5 Claims, 9 Drawing Figures

FIG.7
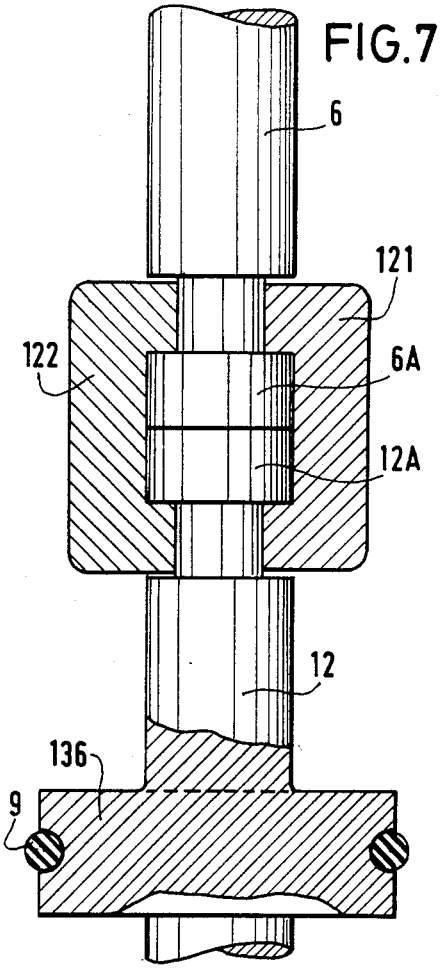
FIG.9
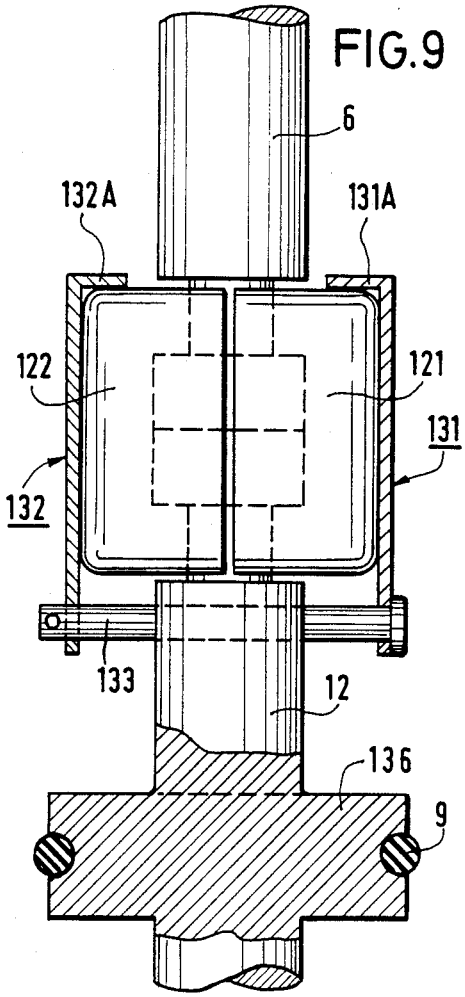
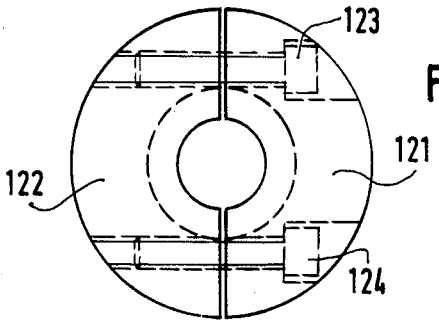
FIG.8

MEANS FOR ASSEMBLING TWO ENCLOSURES OF AN ELECTRICAL CUTOUT APPARATUS

Assignee has previously described in U.S. Pat. No. 4,386,250 a device for assembling together two communicating enclosures of an electrical cutout apparatus filled with a dielectric fluid under pressure and traversed by a control rod for actuating the cutout means, which assembling device, in view of separating the two enclosures 1 and 2, comprises an intermediate, slidable sealing air lock 41 and means 5, 9 operable to simultaneously seal one enclosure on one side thereof and the other enclosure on the other side thereof, said air lock comprising two separable portions 7, 45 which when separated respectively become fast with one and the other enclosures, the part of said control rod 42 within said air lock having means 37, 36 for uncoupling said rod into two sections 6 and 12 each attached to one of said enclosures.

This device is illustrated in FIGS. 1 and 2 hereunto appended, which are identical to FIGS. 1 and 2 of the just-mentioned document.

Air lock 41 consists of a cylindrical space formed between the end of the first part 6 of rod 42 and the inside of a hollow piston 15, said air lock being bounded on one side by a boss 38 on the said first section 6 of the rod cooperating with a first portion 7 of said piston and on the other side by flange 36 on said second section 12 of the rod cooperating with the second portion 45 of said piston.

The first enclosure 1 is provided, at its lower end, with a first assembly plate 24 for mounting on a second assembly plate 44 on the upper end of enclosure 2, said first plate comprising a cylindrical sleeve 23 against the inside of which is arranged a slide block 19 attached to the second plate and carrying a sealing ring 25.

The head 7 of piston 15 is slidably arranged and fitted with a seal 4 within cylindrical sleeve 23 and the base or outwardly-directed bottom flange 46 of piston 15 is slidably arranged and fitted with sealing means 10 within slide block 19.

The head 7 of piston 15 is provided with means 8 to make it fast with piston 15 body 45 and with plate 24 and is provided with means 40 to make it fast with the first section 6 of rod 42 when the two portions 7, 45 of piston 15 are separated.

In the previously mentioned invention and as can be seen from FIG. 2 of the drawings appended hereto, manouvering of the piston's cylindrical body during dismantling is carried out by screws 14 working against the pressure of a spring 16.

Said spring 16 imparts motion to the cylinder body during reassembly.

It is an object of the present invention to replace these screws 14 and the spring 16 by a single, more easily manouvered device.

In the previously mentioned patent specification, the operating or control rod and the insulating rod 12 are assembled together with means including a flange 36, a cooperating flange 37 and screws 13.

It is an object of the present invention to specify simpler and more readily assessible assembly means.

The invention will now be described in detail with reference to the appended drawings in which:

FIG. 7 is a longitudinal sectional view of a linkage between the operating or control rod and the insulating rod according to the present invention;

FIG. 8 is a top view of the device or linkage of FIG. 7;

and FIG. 9 is an axial cross-section of an alternative embodiment of the assembly device according to the invention.

Figure 1:
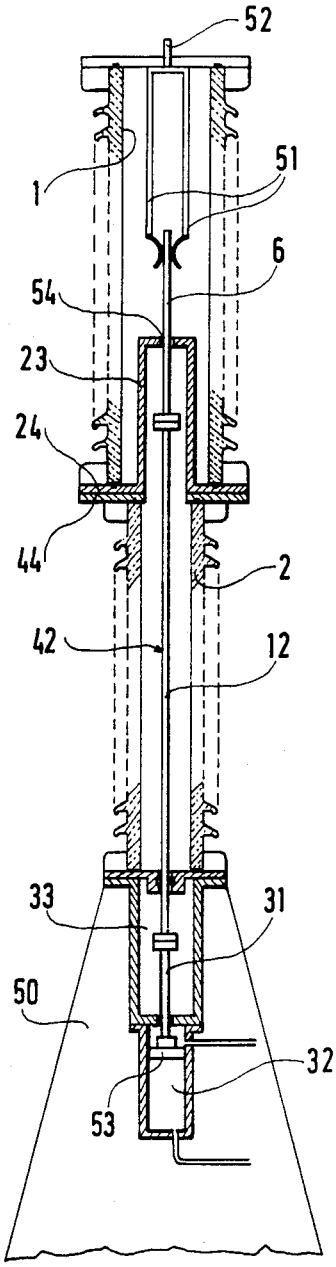
FIG. 1 is a schematic general half cross-section of a compressed gas cutout apparatus in closed position, according to the reference document.
Figure 2:
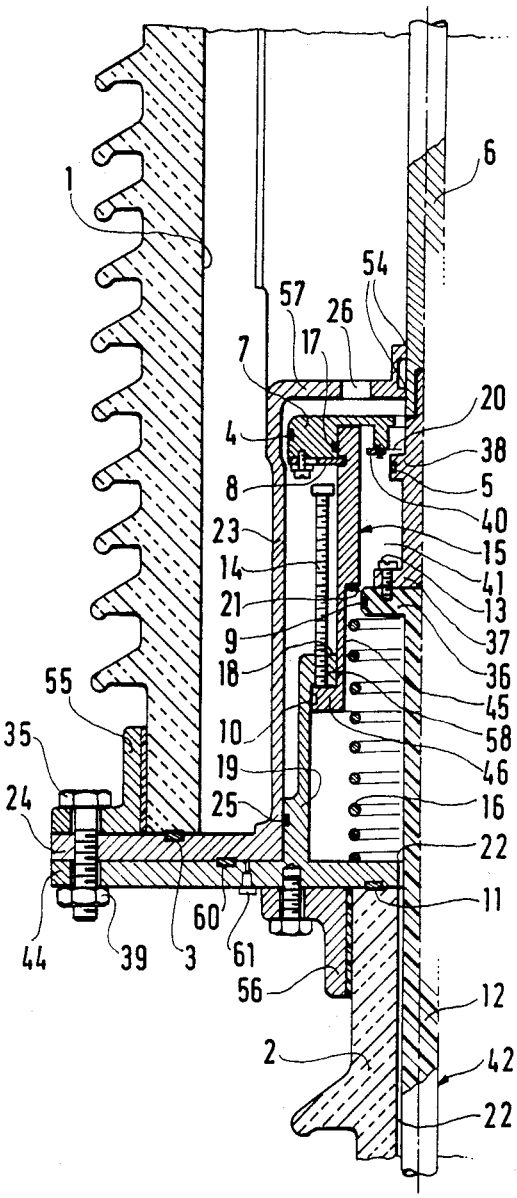
FIG. 2 is a schematic half cross-section detailing the assembly device between two enclosures of the cutout apparatus of FIG. 1, in closed position, according to the reference document.

FIGS. 1 and 2 illustrate the prior art.

In FIG. 1 is shown a cutout apparatus comprising, at the top, a cutout chamber 1 formed by a cylindrical ceramic insulator assembled on a cylindrical insulating support 2 resting on a metal frame 50. The cutout chamber contains stationary contact fingers 51 connected to an external connection terminal 52. The stationary contact fingers cooperate conventionally with a moving contact formed at the end of a rod 6 lying on the axis of the cutout chamber.

Rod 6 constitutes the upper portion of the moving contact control or operating rod which is altogether designated by the reference 42 and which includes a second, insulating section 12 and a third section 31. The insulating section 12 passes through cutout chamber 1, insulating support 2 and an intermediate chamber 33 interposed under the insulating support 2, between said support and an operating jack 32. Rod portion 31 is connected firstly, inside chamber 33, to section 12 of the insulating rod and secondly to the piston 53 of jack 32 which controls the operation of moving contact control rod assembly 42 as a whole.

Rod 6, which is conductive, is otherwise connected via a sliding contact 54 and a cylindrical sleeve 23 to a plate 24 supporting an external connection terminal, not shown.

The enclosures formed by the cutout chamber 1, the insulating support 2 and the intermediate chamber, all of which are traversed by control rod 42, are filled with a dielectric gas and are sealed with respect to the outside, yet normally communicate with one another.

FIG. 2 shows in detail how the cutout chamber 1 and the insulating support 2 are assembled together. At the lower end of the cutout chamber 1, a fixing collar 55 is screwed onto an annular plate 24. At the upper end of the insulating support 2, another fixing collar 56 is screwed onto an annular plate 44. The assembly formed by retaining collar 55 and plate 24 is secured to plate 44 by means of bolts 35 and nuts 39. Sealing is provided between chamber 1 and plate 24 by a seal 3 and between insulating support 2 and plate 44 by a seal 11.

Annular plate 24 has a cylindrical sleeve 23 on its inner periphery, which sleeve extends inside cutout chamber 1, and includes an annular top 57 surrounding rod 6 and carrying sliding contact 54 at its center. Said top 57 also includes orifices 26.

The inner periphery of annular plate 44 is disposed facing a passage 22 which surrounds the insulating rod 12. Plate 44 also includes a slide block 19 whose base adjoining said plate is provided with a sealing ring 25 which cooperates with the inner wall of the cylindrical sleeve 23 in which it is inserted. The end of the slide block 19 is provided with an inwardly directed flange 18 having tapped through-holes 58 therein, running parallel to rod 42.

A hollow piston assembly referenced 15 is disposed round rod sections 6 and 12 and between cylindrical sleeve 23 and slide block 19.

Piston 15 includes firstly a cylindrical body 45 with an outwardly directed flange 46 disposed under flange 18 and is provided with a sealing ring 10 which cooperates with the inside of the slide block 19, and secondly a cylindrical annular head 7 with sides which extend beyond the walls of the cylindrical body 45. The outer wall of the head 7 is fitted with a seal 4 which is designed to cooperate with the inner wall of cylindrical sleeve 23 and a sealing ring 17 is inserted between the cylindrical body 45 and said head 7. A compression spring 16 is interposed between body 45 and plate 44 in a recess in said body, and adjusting screws 14 are engaged in tapped holes 58, with heads facing lug or dog 8.

The upper end of insulating rod 12 has a circular flange 36 whose peripheral surface is provided with a sealing ring 9 designed to cooperate with the inner wall of cylindrical body 45.

A cooperating flange 37 on the lower end of rod 6 is attached to flange 36 with screws 13. Rod 6 further includes a circular boss 38 whose periphery is provided with a sealing ring 5 designed to cooperate with the inner wall of piston head 7.

In FIG. 2, which illustrates the cutout apparatus in closed position, operating rod 42 is shown driven by the jack 32 into high position, in which position a variable volume is formed between rod 6 and cylindrical body 45 on the one hand and between flange 36 and the inner side of piston head 7 on the other hand. Said variable volume in fact established an air lock 41 which, on one side, has an annular passage 21 between the end of flange 36 and cylindrical body 45 and, on the other side, has an annular passage 20 between the boss 38 and the inner side of piston head 7.

The two enclosures, namely cutout chamber 1 and insulating support 2, are gastight and are filled with dielectric gas under pressure. However, gas flows freely between the two enclosures through orifices 26, passage 20, air lock 41, passage 21 and passage 22 between insulating rod 12, plate 44 and insulating support 2.

When the cutout apparatus is in open position, with the control rod 42 pulled down by the operating jack 32, annular passages 20 and 21 open wider the air lock 41 and the enclosures still communicate with each other.

In the following FIGS., 3 through 6, illustrating one of the improvements of the invention, items unchanged from FIGS. 1 and 2 bear like references.

Figure 3:
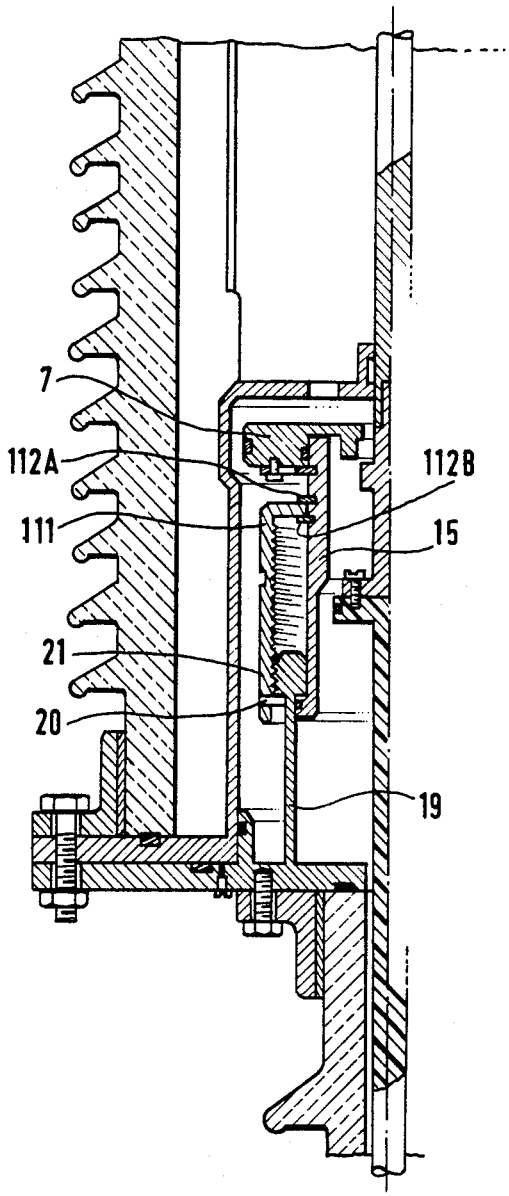
FIG. 3 is a schematic half cross-section of the single device for manouvering the cylindrical body, in closed position, according to the present invention.

As can be seen from FIG. 3, screw 14 and spring 16 have been eliminated and are replaced by a sleeve 111 rotating between two retaining rings 112 which secure it to piston 15.

Sleeve 111 is internally threaded and cooperates with a matching thread on the outside of slide block 19, an added advantage of this arrangement being the elimination of the lug 40 on piston head 7.

With the cutout apparatus in closed position, the cutout chamber can be dismantled and separated from the insulating support 2 as follows. As a first step, ending with the device configured as in FIG. 3, the two enclosures are first separated from one another by removing the nuts 39 from their joining bolts 35, then plate 24 and cutout chamber 1 are lifted off plate 44 with the help of suitable hoisting means, not shown. During this operation, the cylindrical sleeve 23 slides firstly along slide block 19, then on piston head 7. Tightness is ensured for the cutout chamber 1, at first by seal 25, then simultaneously by seals 25 and 4, prior to seal 25's separation from sleeve 23.

Figure 4:
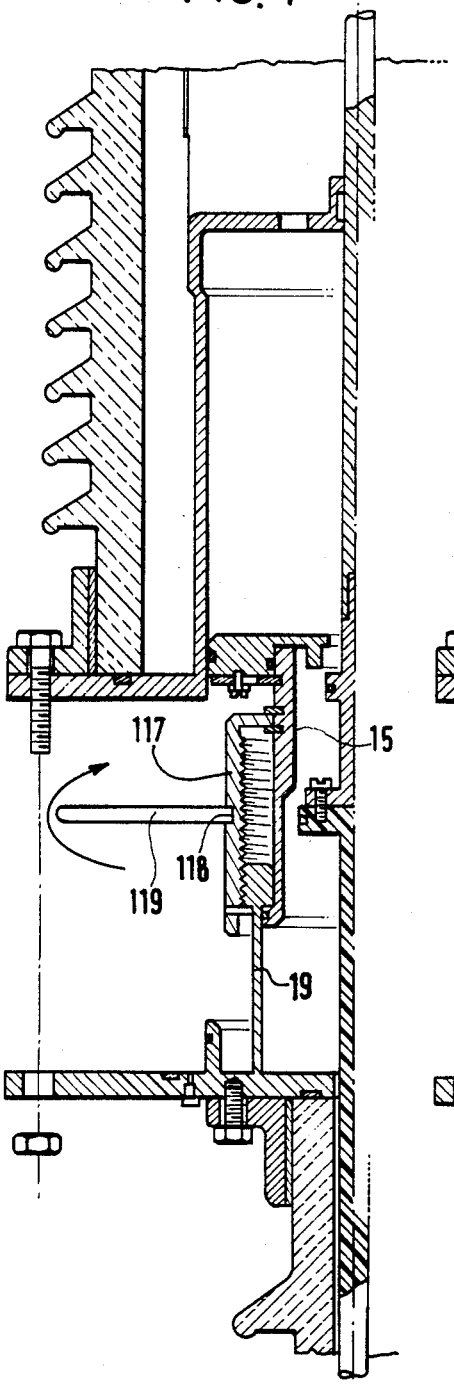
FIGS. 4 through 6 illustrate the assembly device of FIG. 3 in various stages of disassembly.
Figure 5:
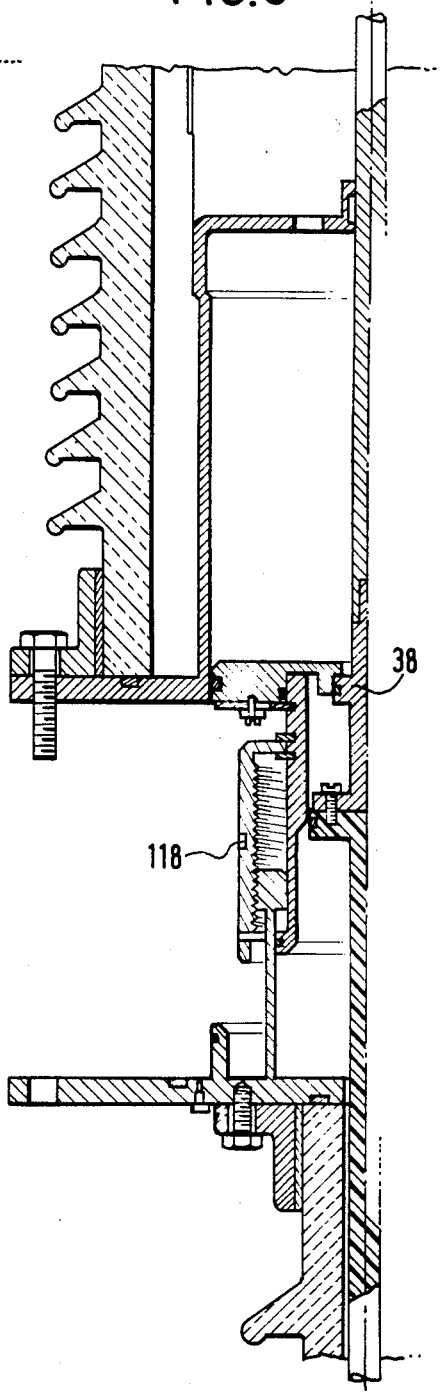
Figure 6:
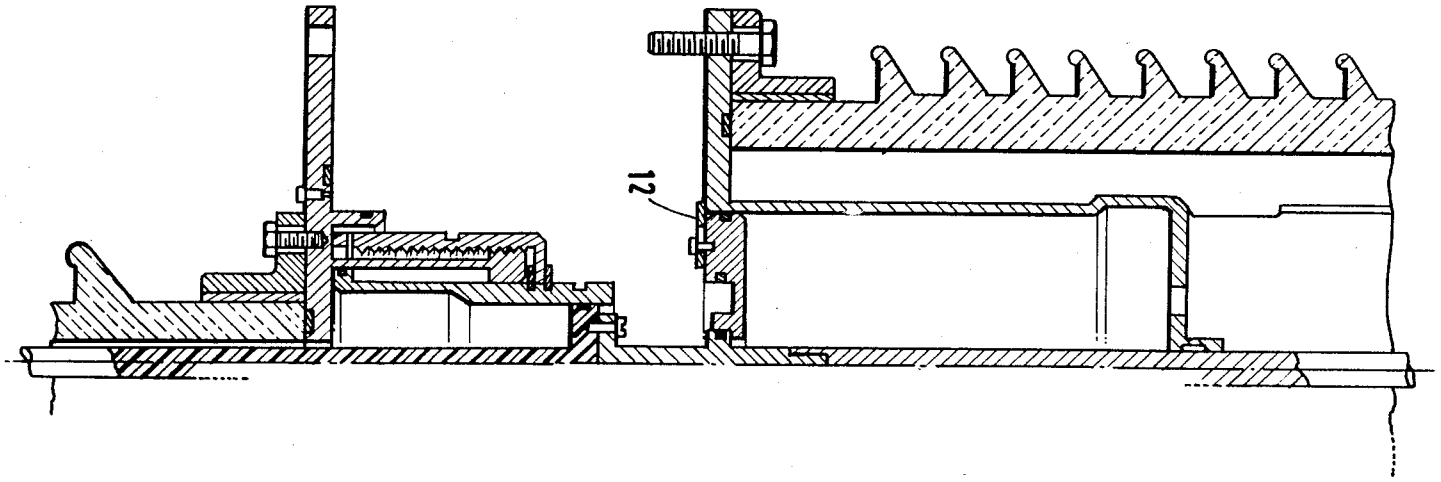

As a second step, ending with the device configured as in FIG. 4, sleeve 117 is screwed onto slide block 19.

Holes such as hole 118 drilled into the outside of the sleeve enable a control rod or spindle 119 to be inserted. The sleeve drives piston 15 whose head 17 presses sealingly against boss 38, seal 5 providing the seal (FIG. 4). Head 7 is then separated from piston 15 by working lug 8, after which screwing on of the sleeve is continued until it abuts plate 44.

Access has thus been gained to the insulating rod 12-to-rod 6 fastening screws 13.

Having removed screws 13, it is possible to completely separate cutout chamber 1 from insulator 2 without loss of tightness for their enclosures.

Reassembly is carried out by following the same steps in reverse.

As can be seen from FIGS. 3–6, fastening screws 13 have a vertical axis which can make their disassembly awkward.

In accordance with the present invention, assembly can be simplified by milling two necks towards the end of rods 6 and 12 to create two heads 6A and 12A which can then be assembled by means of two half-shells or female molds 121 and 122 clampable by means of screws 123, 124 inserted through tapped holes therein. As an alternative, not specifically illustrated, the holes can be made smooth and the two halves clamped by means of nuts and bolts. The holes being drilled perpendicular to rods 6 and 12 enables easy access to the screws with a screwdriver.

In another alternative embodiment shown in FIG. 9, the two half-shells are not drilled but are instead clamped together by means of two half-sleeves 131, 132 with gripping shoulders 131A, 132A, assembled with pins such as 133 or with bolts.

If rods 6 and 12 are assembled by any of the methods represented in FIGS. 7 and 9, seal 9 is disposed on a boss 136 near the end of rod 12.

What is claimed is:

1. Means for assembling together two communicating enclosures of an electrical cutout apparatus filled with a dielectric fluid under pressure and traversed by a control rod for actuating the cutout means, which assembling means comprises, in view of separating said two enclosures, an intermediate, slidable sealing air lock and two vertically spaced apart sealing rings on a boss and a flange respectively of said control rod, operable to simultaneously seal one enclosure on one side of the air lock and the other enclosure on the other side of the air lock, said air lock comprising two separable portions which when separated respectively become fast with one and the other enclosures, the part of said control rod within said air lock having two cooperating circular flanges separable for separating said rod into first and second sections which are fast with respective portions of said enclosures, said air lock consisting of a cylindrical space formed between the end of said first section of the rod and the inside of a hollow piston and being bounded on one side by said seal-fitted boss on said first rod section cooperating with a first portion of said piston and on the other side by said seal-fitted flange on said second section of the rod cooperating with the second portion of said piston, said first enclosure having at its lower end a first assembly plate for mounting on a second assembly plate on the upper end of said second enclosure, said first plate comprising a cylindrical sleeve against the inside of which is arranged a slide block attached to said second plate and also carrying a sealing ring, said first portion or head of said piston being slidably arranged and fitted with a seal within said cylindrical sleeve and said second or outwardly directed bottom flange portion of said piston being slidably arranged and fitted with sealing means within said slide block, wherein said assembling means is provided an internally threaded sleeve screwably cooperating with a thread on a portion of the outside surface of said slide block and is further provided with means for making said threaded sleeve and said piston slidably fast.

2. Assembling means according to claim 1, wherein said means for making slidably fast the threaded sleeve and the piston consist of two spring retaining rings surrounding said piston.

3. Assembling means according to claims 1 and 2, wherein said first and second sections of the control rod each comprise a knob on their facing ends and said knobs are attached together by means of two half-shells clamped together by suitable joining means.

4. Means according to claim 3, wherein said joining means for the half-shells consist of screw fasteners inserted into holes provided in the two half-shells.

5. Means according to claim 3, wherein said joining means for the half-shells consist of two half-sleeves with shoulders thereon, pressing against said half-shells and of a pin or bolt-type fastener.

* * * * *